US005822671A

United States Patent [19]

Takama

[11] Patent Number: 5,822,671

[45] Date of Patent: Oct. 13, 1998

[54] IMAGE FORMING METHOD AND APPARATUS FOR FORMING A RESIN-FORMED IMAGE ON A FABRIC, FIBER OR OTHER SUCH RECORDING MEDIUM

[75] Inventor: Masaaki Takama, Toyonaka, Japan

[73] Assignee: Minolta Co., Ltd., Osaka, Japan

[21] Appl. No.: 451,401

[22] Filed: May 26, 1995

[30] Foreign Application Priority Data

May 31, 1994 [JP] Japan ..... 6-118521

[51] Int. Cl.[6] ..... G03G 15/20

[52] U.S. Cl. ..... 399/342; 430/97

[58] Field of Search ..... 355/282, 202, 355/200; 430/18, 104, 106, 106.6, 97; 399/122, 320, 341, 342

[56] References Cited

U.S. PATENT DOCUMENTS 4,526,847 7/1985 Walker et al. ..... 430/18
5,395,717 3/1995 Ozawa et al. ..... 430/106.6
5,489,967 2/1996 Sakagami et al. ..... 355/202

FOREIGN PATENT DOCUMENTS 58-059455 4/1983 Japan .
60-135974 7/1985 Japan .
63-2089 1/1988 Japan .
5-27474 2/1993 Japan .
6-043724 2/1994 Japan .

*Primary Examiner*—Shuk Lee
*Attorney, Agent, or Firm*—Sidley & Austin

[57] ABSTRACT

An image forming apparatus and an image forming method including a first process in which a resin-formed image is formed on a recording medium, and a second process in which the image formed on the recording medium is brought into contact with a solution containing a plasticizer which plasticizes the resin contained in the image.

25 Claims, 2 Drawing Sheets

IMAGE FORMING METHOD AND APPARATUS FOR FORMING A RESIN-FORMED IMAGE ON A FABRIC, FIBER OR OTHER SUCH RECORDING MEDIUM

BACKGROUND OF THE INVENTION

1. Field of the Invention

The present invention concerns an image forming method and an image forming apparatus which form a resin-formed image on a fabric, fiber, nonwoven fabric, or other such recording medium.

2. Description of the Related Art

In recent years, the use of electrophotographic processes has grown increasingly broad, and such processes have drawn attention as a method for recording on fibers and fabrics, etc., as well as regular paper, the ordinary recording medium up to the present. For example, a technology for recording a polyamide resin particle image on a synthetic fiber or a natural fiber such as cotton, wool, hemp, silk, or rayon by means of an electrostatic-type electrophotographic process is disclosed in Japanese Laid-Open Patent Application No. HEI 5-27474. Ordinarily, the fixing method in an electrophotographic process is a method in which a toner image adhering to a recording medium is fixed using heat or pressure, and in the above-noted publication as well, a toner is fixed to a recording medium by means of a fixing method jointly employing heat and pressure.

However, when a toner image is formed on a fabric by means of the method pertaining to the above-noted publication, an inconvenience arises in that image areas to which toner has adhered become stiffer than fabric areas where an image has not been formed, and the hand of the fabric is impaired. In addition, because the stiffness of image areas and fabric areas differs, another inconvenience occurs in that image areas readily crack when the fabric is folded. The occurrence of such inconveniences is pronounced in electrophotographic full color image processing in which image reproduction is carried out by using three or four color toners and overlaying each color toner. Specifically, in full color image processing, the formation of an image area by overlaying multiple color toners, and the frequent formation of solid images cause a pronounced difference between the stiffness of a fabric and an image area.

In the technology described in the above-noted publication, in fixing methods employing heat and pressure, the use of a special toner in which a polyamide resin serves as a binding resin improves fixing properties with respect to the fabric. Ordinarily, though, a polyester or styrene-acryl-based resin is commonly used as the resin component of a toner. Thus, the technology described in the above-noted publication which employs a special toner discussed above is a poor technology in terms of versatility. In the above-noted publication, where a toner employing a commonly used, above-noted resin is concerned, there is no description whatsoever regarding improvement of fixing properties with regard to a fabric or other recording medium.

SUMMARY OF THE INVENTION

An objective of the present invention is to offer an image forming method and an image forming apparatus which do not adversely affect the hand of a fabric even when an image is formed using the fabric as a recording medium and using a printing medium containing a resin component.

Another objective of the present invention is to offer an image forming method and an image forming apparatus whereby adequate fixing strength is obtained even when an image is formed using the above-noted printing medium and using a recording medium such as a cloth having an uneven surface or a paper having an internal mesh structure of intertwined fibers.

These and other objects, advantages and features of the invention will become apparent from the following description thereof taken in conjunction with the accompanying drawings which illustrate specific embodiments of the invention.

DETAILED DESCRIPTION OF THE INVENTION

Figure 1:
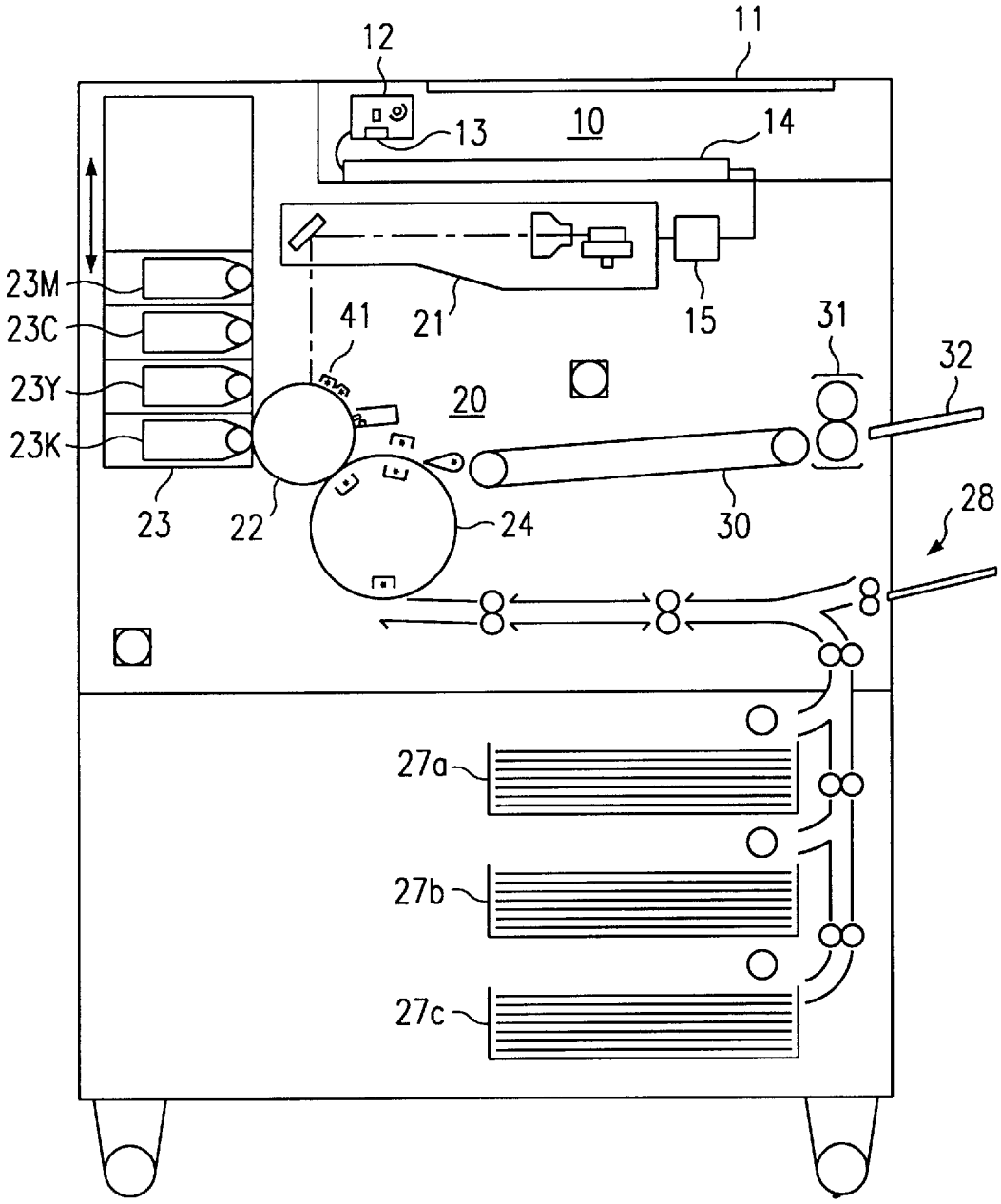
FIG. 1 (PRIOR ART)
FIG. 1 is a cross-sectional drawing of a color copying machine showing one embodiment of an apparatus which forms a resin-formed image on a recording medium.

The present invention concerns an image forming apparatus and an image forming method including a first process in which a resin-formed image is formed on a recording medium, and a second process in which the image formed on the recording medium is brought into contact with a solution containing a plasticizer which plasticizes the resin contained in the image.

The first process in which a resin-formed image is formed on a recording medium is carried out by means of an image forming method such as: a method in which an image is formed by using a printing medium containing a resin component on a photosensitive medium, electrostatic recording medium, magnetic latent image carrier, or other image carrier, then the image is transferred onto a recording medium electrostatically or by pressure; a method in which a printing medium image containing a resin component formed on an image carrier is electrostatically transferred to an intermediate transfer medium such as ordinary paper and is again electrostatically transferred from the intermediate transfer medium to a recording medium; a method in which a latent image is formed directly on a recording medium and developed by a printing medium containing a resin component; or a method in which a resin-formed image is formed directly on a recording medium by an ink jet, etc. In addition, heat or pressure may be applied to a recording medium on which a printing medium image containing a resin component is formed by an above-noted method in order to heighten the adhesion of the printing medium to the recording medium. Furthermore, any method for forming an image of a printing medium containing a resin component on a recording medium is acceptable, with no limitation to the above-noted methods. Among the above-stated methods as well, methods for forming an image by means of an electrophotographic process are favorable in terms of versatility.

In the second process, the resin-formed image on the recording medium, formed in the first process, is brought into contact with a solution containing a plasticizer.

The plasticizer has the effect of plasticizing (lowering elastic modular or glass transition point and imparting pliability) a resin. Specifically, the plasticizer is a solvent of relatively low volatility which has the effect of penetrating between resin molecules, weakening the van der Waals' bonds that cause the rigid net-like structure of the resin, and imparting pliability to the resin. Thus, in the second process, the printing medium is plasticized and endowed with pliability, and the inconvenience wherein image areas become stiffer than a fabric or other recording medium and hand is adversely affected is thus resolved.

In addition, the plasticizer has the effect of imparting pliability to the resin component of a printing medium and the effect of swelling or dissolving the resin component. Thus, in the second process, adequate fixing properties can be obtained with respect to a recording medium having an uneven nonwoven fabric or other such surface, a paper, or a textile or other such recording medium having a net-like structure.

The solution brought into contact with an image formed on a recording medium is one containing a plasticizer which plasticizes a resin component. For example, in electrophotographic processes widely used as image forming methods a toner is used as a printing medium, and a resin component is added to the toner to bring about fixing on a recording medium. This resin component is plasticized by the above-noted solution, and hereinafter, such a solution is termed a "finishing solution."

Examples of substances which may be used as the plasticizer contained in a finishing solution include phosphoric esters such as trimethyl phosphate, triethyl phosphate, tributyl phosphate, tri-2-ethylhexyl phosphate, tributoxyethyl phosphate, trioleyl phosphate, triphenyl phosphate, tricresyl phosphate, trixylenyl phosphate, cresyldiphenyl phosphate, xylenyldiphenyl phosphate, and 2-ethylhexyldiphenyl phosphate; phthalate esters such as dimethyl phthalate, diethyl phthalate, dibutyl phthalate, diheptyl phthalate, di-2-ethylbutyl phthalate, di-2-ethylhexyl phthalate, di-n-octyl phthalate, diisooctyl phthalate, didecyl phthalate, diisodecyl phthalate, butylbenzyl phthalate, diisononyl phthalate, dicapryl phthalate, octyldecyl phthalate, butylbenzyl phthalate, dibutoxyethyl phthalate, and ethylphthalyl ethylglycolate; trimellitic acid esters such as tri-2-ethylhexyl trimellitate; aliphatic monobasic acid esters such as butyl oleate, tetrahydrofurfuryl oleate, and glycerol monooleic acid ester; aliphatic dibasic acid esters such as dimethyl adipate, diethyl adipate, dibutyl adipate, diisobutyl adipate, di-n-hexyl adipate, 2-ethylhexyl adipate, isodecyl adipate, di-n-octyl adipate, dibutyldiglycol adipate, di-2-ethylbutyl azelate, di-2-ethylhexyl azelate, dimethyl sebacate, diethyl sebacate, dibutyl sebacate, octyl sebacate, di-2-ethylhexyl sebacate, and capryl sebacate; dihydric alcohol esters such as diethylene glycol dibenzoate, triethylene glycol-2-ethyl butyrate, triethylene glycol di-2-ethylhexoate, and dibutyldiglycol adipate; and oxyacid esters such as methylacetyl ricinoleate, butylacetyl ricinoleate, methoxyethylacetyl ricinoleate, butylphthalylbutyl glycolate, and tri-(2-ethylhekyl) acetylcitrate.

Other examples of the plasticizer include chlorinated paraffin, chlorinated biphenyl, 2-nitrobiphenyl, dinonylnaphthalene, o-toluene sulfonethylamide, N-butylbenzene sulfonamide, camphor, methyl abietate, 1,3-butyleneglycol adipate and the like.

Plasticizers having low volatility and low kinetic properties in addition to the above-discussed plasticizing effect are favorable as plasticizers. Low volatility has the effect of suppressing odor, and low kinetic properties have the effect of preventing migration of the plasticizer from the resin component of the printing medium to external substances such as water or oils. Plasticizers of high molecular weight have low volatility, those with short alkyl groups or an aromatic ring have low kinetic properties with respect to oils, and those with long alkyl groups have low kinetic properties with respect to water.

Consequently, among the above-noted plasticizers, the use of di-2-ethylhexylphthalate, tri-2-ethylhexyltrimellitate, di-2-ethylhexyl sebacate, di-n-octyl phthalate, diisodecyl adipate, diisodecyl phthalate, diisononyl phthlate, dibutyldiglycol adipate, di-2-ethylhexyl azelate, or trixylenyl phosphate or the like is favorable in terms of low volatility. The use of an ester consisting of methanol or ethanol and an acid having an aromatic ring structure is favorable in terms of low kinetic properties with respect to oils; for example, a diester phthalate such as dimethyl phthalate or diethyl phthalate, or a trimellitic triester or the like. And the use of di-2-ethylhexyl adipate, diisodecyl adipate, di-2-ethylhexyl sebacate, or tri-2-ethylhexyl phosphate or the like is favorable in terms of low kinetic properties with respect to water.

In addition, because a given type of plasticizer brings about a plasticizing effect on given types of resins, the plasticizer may be selected and used according to the type of resin used in the printing medium or according to the application of the recording medium used.

The finishing solution may employ as much as 100 percent-by-weight plasticizer, but with a plasticizer alone, dissolving strength with regard to the resin component is overly strong and an image is sometimes disturbed. Thus, a favorable finishing solution is one containing a solvent which is compatible with the plasticizer and does not dissolve the resin component of the printing medium, or one containing a surfactant and containing a solvent which is not compatible with the plasticizer and does not dissolve the resin component of the printing medium.

The added amount of plasticizer in the finishing solution is 1 percent-by-weight or more with respect to the total amount of the solution, and favorably 10 percent-by-weight or more. When the added amount is less than 1 percent-by-weight, the above-discussed effects of improved hand and improved fixing properties are no longer adequately obtained. There is no specific upper limit to the added amount of plasticizer, and an amount not causing image disturbances in the second process is acceptable; for example, if a plasticizer having little dissolving strength with regard to the resin component of a printing medium is used, as much as 100 percent-by-weight plasticizer may be used.

Solvents jointly usable with the plasticizer include water; ethyl laurate; higher aliphatic acid esters such as linoleic acid esters; aromatic hydrocarbons (derivatives) such as benzene, toluene, and xylene; alicyclic hydrocarbons (derivatives) such as cyclohexane and cyclohexanone; halogenated hydrocarbons such as methylene chloride, trichloroethane, and carbon tetrachloride; ethers such as THF; ketones such as acetone and methyl ethyl ketone; and alcohols such as methanol, ethanol, and isopropyl alcohol; and such solvents may be used individually or may be blended and used.

Surfactants may also be added to the finishing solution.

When a surfactant is used, said surfactant is combined with a solvent which is not compatible with the plasticizer and which does not dissolve the resin component of the printing medium, and a plasticizer emulsion which does not dissolve the resin component is formed within the solvent.

Surfactants which may be used include anionic surfactants, nonionic surfactants, cationic surfactants, and amphoteric surfactants and the like.

Specific examples of anionic surfactants include aliphatic acid chlorides, alkyl sulfates, alkylbenzene sulfonates, alkylnaphthalene sulfonates, alkylsulfosuccinates, alkyldiphenylether disulfonates, naphthalenesulfonic acid/formalin condensation products, and polycarboxylic acid polymer surfactants.

Specific examples of nonionic surfactants include polyoxyethylene alkyl ether, polyoxyethylene alkyl allyl ether, oxyethylene-oxypropylene copolymers, sorbitan aliphatic acid ester, polyoxyethylene sorbitan aliphatic acid ester, and polyoxyethylene alkylamine.

Specific examples of cationic surfactants and amphoteric surfactants include alkylamine salts, quaternary ammonium salts, alkylbetaine, and amine oxide.

These surfactants may be used individually, or two or more may be blended and used.

When a surfactant is added, the surfactant is added in a range on the order of 0.1 to 10 percent-by-weight of the total amount of the finishing solution, and favorably, approximately 1 to 3 percent-by-weight. When the added amount is less than 0.1 percent-by-weight, the effects due to the addition are insufficient, and when the added amount exceeds 10 percent-by-weight, foam, etc. proliferates and complicates handling.

Toners usable as a printing medium are not specifically limited, provided such a toner is a conventionally known item. Specifically, usable toners include those containing at least a colorant and a binding resin component, those containing charge control agents or offset preventing agents such as offset-inhibiting waxes, etc. as necessary, and those processed with fluidizing agents.

Examples of resins which may be used as a toner binder include thermoplastic resins such as polystyrene-based resins, poly(meth)acrylic-based resins, polyolefin-based resins, polyamide-based resins, polycarbonate-based resins, polyether-based resins, polysulfone-based resins, polyester-based resins, epoxy-based resins, and butadiene-based resins; and copolymers, block polymers, graft polymers, and polymer blends thereof.

Among the above-mentioned plasticizers, phosphoric esters, aliphatic dibasic acid esters and phthalate esters are favorable for polystyrene-based resins, poly(meth)acrylic-based resins, polyolefin-based resins and butadiene-based resins; N-butylbenzene sulfonamide is favorable for polyamide resins; phosphoric esters and 1,3-butyleneglycol adipate are favorable for polyester resins; and phosphoric esters are favorable for epoxy resins.

The present invention is next described in detail by way of embodiments, but the present invention is not limited thereby.

Preparation of Finishing Solution

Finishing solutions 1 through 20 of the compositions shown in Table 1 were prepared by mixing the components. The plasticizer characteristics noted in Table 1 are the particularly superior characteristics possessed by the plasticizers used in the finishing solutions.

TABLE 1

| Finishing Solution | Plasticizer (percent-by-weight) | Solvent (percent - by - weight) | Surfactant (percent-by-weight) | Plasticizer Characteristics |
|---|---|---|---|---|
| 1 | Tributyl phosphate (20) | Ethanol (80) | | Light resistance, Cold resistance |
| 2 | Tricresyl phosphate (10) | Methanol (90) | | |
| 3 | Dimethyl phthalate (60) | Methanol (40) | | Heat resistance |

TABLE 1-continued

| Finishing Solution | Plasticizer (percent-by-weight) | Solvent (percent - by - weight) | Surfactant (percent-by-weight) | Plasticizer Characteristics |
|---|---|---|---|---|
| 4 | Diethyl phthalate (50) | Methanol (50) | | |
| 5 | Dibutyl phthalate (20) | Methanol (80) | | |
| 6 | Dibutyl phthalate (20) | Water/ Acetone (40/40) | | |
| 7 | Dibutyl phthalate (30) | Water (49) | | |
| 8 | Diisodecyl phthalate (5) | Methanol (95) | | |
| 9 | Tri-2-ethylhexyl trimellitate (30) | Methanol (70) | | Low volatility |
| 10 | Butyl oleate (30) | Ethanol (70) | Dodecyl-benzene sulfonate (1) | Soap/water extraction resistance |
| 11 | Dimethyl adipate (70) | Ethanol (30) | | |
| 12 | Dibutyl adipate (40) | Ethanol (60) | | |
| 13 | Dibutyldiglycol adipate (20) | Ethanol (80) | | |
| 14 | Dibutyl sebacate (40) | Ethanol (60) | | Low volatility |
| 15 | Dibutyldiglycol adipate (20) | Methanol (80) | | Tasteless /odorless |
| 16 | Methylacetyl ricinoleate (30) | Methanol (70) | | Cold resistance, Durability, Oil resistance |
| 17 | Dimethyl phthalate (100) | | | |
| 18 | | Water/ Acetone (50/50) | | |
| 19 | | Toluene (100) | | |
| 20 | | Ethanol (100) | | |

Toner Image Forming Example 1

A polyester cloth attached to a paper mount (ordinary paper) was prepared as a recording medium. Using a commercial full color copy machine (CF-80: Minolta), a toner image was formed on the above-noted recording medium. Each toner (yellow, cyan, magenta and black toner for CF-80; Minolta) used in the aforementioned full color copy machine contained a polyester resin as a resin component. These toners are referred to as Toner 1.

An original document having white image regions and dark solid image region is used as a image sample.

Description of Image Forming Process and Structure of Above-Noted Full Color Copy Machine FIG. 1 shows the structure of above-noted digital full color copy machine. This copy machine comprises reading portion 10 for reading an image from an original document and printer portion 20 for forming an image on a recording medium.

In reading portion 10, scanner 12 moves downwardly along document platen 11 and scans the image surface of an original document placed on document platen 11, and after image sensor (CCD) 13 photoelectrically converts the reflected image light to red (R), green (G), and blue (B) components, image signal processing unit 14 executes a predetermined image processing to produce digital image data which comprises cyan (C), magenta (M), yellow (Y), and black (Bk). Said image data are stored in buffer memory 15.

Printer portion 20 mainly comprises laser generator 21, photosensitive drum 22, developing unit 23, paper feed cassettes 27*a,* 27*b* and 27*c,* manual paper feeder 28, conveyer belt 30, transfer drum 24 and fixing unit 31.

Laser generator 21 sequentially emits a laser beam based on C, M, Y, and Bk image data stored in buffer memory 15 to photosensitive drum 22.

The laser beam emitted from laser generator 21 scans the surface of photosensitive drum 22 which is uniformed charged by charger 41 and rotates at constant speed. Thus, an electrostatic latent image corresponding to the aforesaid digital image data is formed on the surface of the photosensitive drum 22.

The aforesaid electrostatic latent image is developed by toner from the developing unit 23, and said toner image is subsequently transferred to a recording medium adhered to the surface of transfer drum 24, as described hereinafter.

Developing unit 23 comprises four developing devices 23M, 23C, 23Y, 23K which respectively accommodate developers incorporating magenta toner, cyan toner, yellow toner, and black toner. Developing unit 23 is constructed to move vertically, and a specified developing device is positioned at a developing position confronting to photosensitive drum 22.

The recording medium is fed from manual paper feeder 28 or paper feed cassette 27*a,* 27*b* or 27*c* and advanced toward the transfer drum 24 via a group of rollers until said recording medium is wrapped around transfer drum 24.

A laser beam irradiates the surface of photosensitive drum 22 previously uniformly charged in accordance with cyan image data stored in buffer memory 15. Then, developing device 23C is disposed at the developing position, and development by cyan toner is accomplished. The cyan toner image formed on the surface of photosensitive drum 22 is transferred onto the recording medium adhered to transfer drum 24.

Then, the surface of photosensitive drum 22 is again uniformly charged, and irradiated by a laser beam in accordance with magenta image data. Developing device 23M is disposed at the developing position, and development is accomplished. The magenta toner image formed on the surface of photosensitive drum 22 is transferred so as to be overlaid on the cyan toner image on the recording medium adhered to transfer drum 24.

Thereafter, identical processes are executed for the yellow image and black image, which are sequentially overlaid on the recording medium adhered to transfer drum 24. When the aforesaid overlays are complete, the recording medium is peeled from the transfer drum 24, the recording member is subjected to the image fixing process by the fixing unit 31.

Fixing unit 31 contain a pair of rollers heated by a heater and applying contact pressure to one another. The heat roller temperature is 160° C., and the heat roller pressure is 2.5 kgf/cm$^2$. After passing through fixing rollers, the recording medium is ejected into paper ejection tray 32.

Toner Image Forming Example 2

A toner image was formed as in the above-noted Toner Image Forming Example 1, with the exception that the toners used were a yellow toner, a cyan toner, a magenta toner, and a black toner (Toner 2) obtained through the following manufacturing examples.

| | |
|---|---|
| Styrene-acryl-methacrylic acid copolymer (Mn: 8000, Mw/Mn: 2.3, Tg: 60° C.) | 100 pbw |
| Charge control agent (E-84: Orient Chemical) | 3 pbw |
| Benzidine-based compound (Toyo Ink) | 4 pbw |

*pbw = parts-be-weight

The above-noted materials were mixed by a Henschel mixer, kneaded by a biaxial extruding kneader, and cooled. The cooled material was then coarsely pulverized, finely pulverized by a fine jet mill, and classified by an air-powered classifier, and toner particles of 10 $\mu$m average diameter were obtained.

These toner particles were blended and processed with a fluidizing agent of 0.8 percent-by-weight hydrophobic titanium oxide (600BS: Teika) and 0.4 percent-by-weight hydrophobic silica (R974: Nihon Aerosil) to form a yellow toner.

Cyan Toner Manufacturing Example

| | |
|---|---|
| Styrene-acryl-methacrylic acid copolymer (Mn: 8000, Mw/Mn: 2.3, Tg: 60° C.) | 100 pbw |
| Charge control agent (E-84: Orient Chemical) | 3 pbw |
| Copper phthalocyanine compound (Toyo Ink) | 4 pbw |

A cyan toner was manufactured as per the yellow toner, with the exception that the above-noted materials were used.

Magenta Toner Manufacturing Example

| | |
|---|---|
| Styrene-acryl-methacrylic acid copolymer (Mn: 8000, Mw/Mn: 2.3, Tg: 60° C.) | 100 pbw |
| Charge control agent (E-84: Orient Chemical) | 3 pbw |
| Azo-based compound (Toyo Ink) | 4 pbw |

A magenta toner was manufactured as per the yellow toner, with the exception that the above-noted materials were used.

Black Toner Manufacturing Example

| | |
|---|---|
| Styrene-acryl-methacrylic acid copolymer (Mn: 8000, Mw/Mn: 2.3, Tg: 60° C.) | 100 pbw |
| Charge control agent (E-84: Orient Chemical) | 4 pbw |
| Benzidine-based compound (Toyo Ink) | 2 pbw |
| Copper phthalocyanine compound (Toyo Ink) | 2 pbw |
| Azo-based compound (Toyo Ink) | 2 pbw |

A black toner was manufactured as per the yellow toner, with the exception that the above-noted materials were used.

Contact Processing with Finishing Solution

Toner images obtained in the above-noted Toner Image Forming Examples 1 and 2 were subjected to contact processing using the above-noted finishing solutions 1 through 20. Combinations of toner types and finishing solutions were as shown in Table 2. Contact processing was carried out by a method in which the cloths bearing the toner images that had been formed were placed flat on a horizontal surface with the toner image surface up, and a solvent used for image forming was uniformly sprayed from above by a sprayer. The cloths were then left to dry in an 80° C. environment.

Evaluation of Hand

Five evaluators performed the following three-grade evaluation based on tactile sensation. Where the evaluations of individual evaluators differ, their average is taken as the evaluation of hand. Results are shown in Table 2.

3: No difference in feel between image area and fabric area.

2: Image area somewhat stiffer than fabric area.

1: Image area clearly stiffer than fabric area.

Evaluation of Fixing Properties

To evaluate any loss of color, each of the cloths obtained after drying was rubbed together in a scrubbing manner for one minute, by hand, in a 0.5% aqueous solution of the surfactant sodium dodecyl sulfate. Results are shown in Table 2. In Table 2, an "O" mark indicates that no color was lost, and fixing properties were excellent, and an "X" mark indicates that loss of color occurred and fixing properties were inferior.

TABLE 2

| | Finishing Solution | Toner | Hand | Fixing Properties |
|---|---|---|---|---|
| Emb. 1 | 1 | 1 | 3 | O |
| Emb. 2 | 1 | 2 | 3 | O |
| Emb. 3 | 2 | 1 | 3 | O |
| Emb. 4 | 3 | 1 | 3 | O |
| Emb. 5 | 4 | 2 | 3 | O |
| Emb. 6 | 5 | 1 | 3 | O |
| Emb. 7 | 6 | 1 | 3 | O |
| Emb. 8 | 7 | 1 | 3 | O |
| Emb. 9 | 8 | 1 | 3 | O |
| Emb. 10 | 9 | 1 | 3 | O |
| Emb. 11 | 10 | 1 | 3 | O |
| Emb. 12 | 11 | 1 | 3 | O |
| Emb. 13 | 12 | 1 | 3 | O |
| Emb. 14 | 13 | 1 | 3 | O |
| Emb. 15 | 14 | 2 | 3 | O |
| Emb. 16 | 15 | 1 | 3 | O |
| Emb. 17 | 16 | 1 | 3 | O |
| Emb. 18 | 17 | 1 | 3 | O |
| Ref. Ex. 1 | — | 1 | 1 | X |
| Ref. Ex. 2 | 18 | 1 | 1 | O |
| Ref. Ex. 3 | 19 | 1 | 1 | O |
| Ref. Ex. 4 | 20 | 1 | 1 | X |

Figure 2:
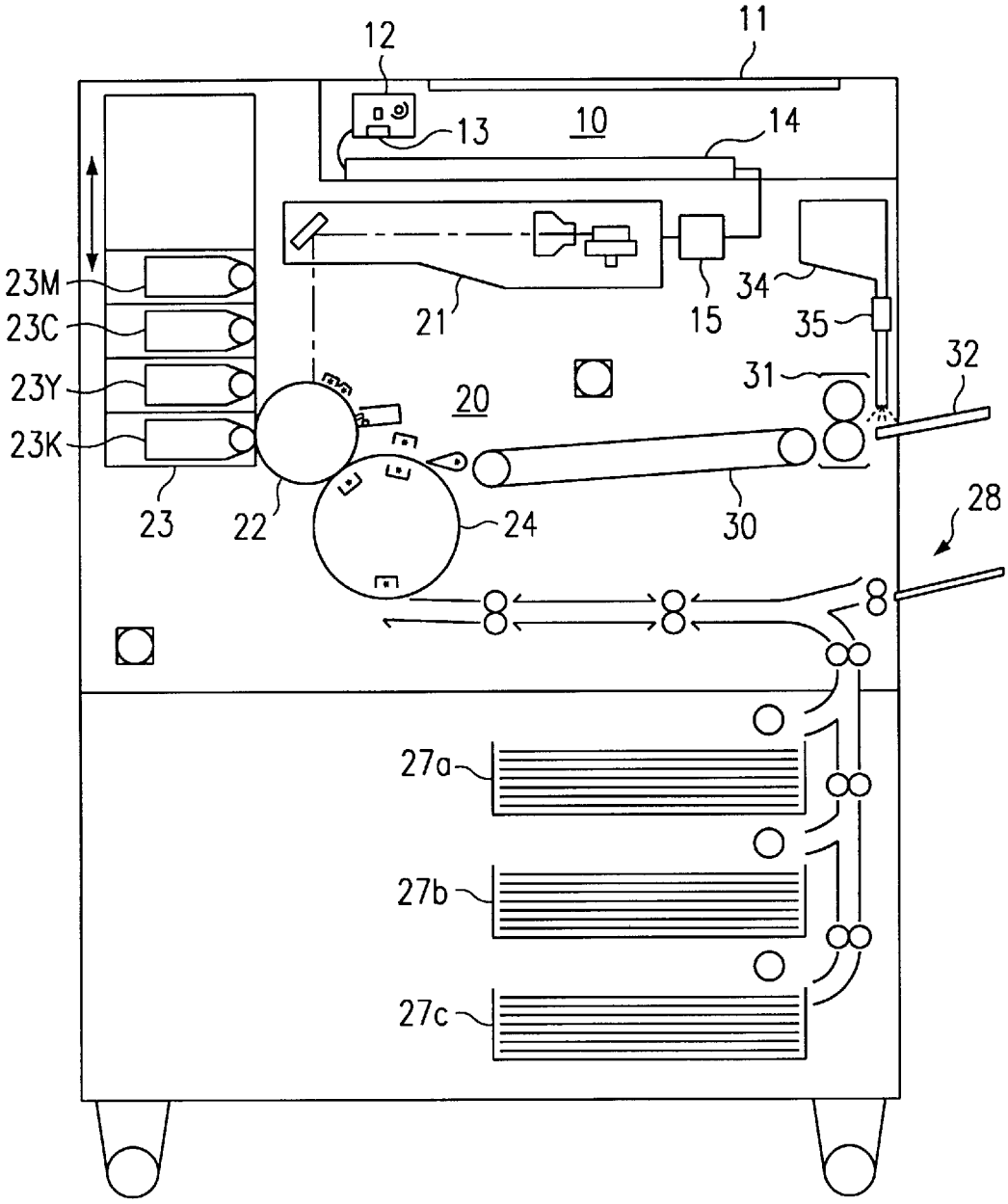
FIG. 2 is a drawing showing one embodiment of an image forming apparatus in which the present invention is applied.

FIG. 2 is a cross sectional drawing showing one embodiment of an image forming apparatus in which the present invention is applied. As shown in FIG. 2, between fixing unit 31 and paper ejection tray 32, this image forming apparatus is equipped with tank 34 which stores a finishing solution, and sprayer 35 which sprays the finishing solution contained in the tank.

After an image is formed on a recording medium and fixing unit 31 completes fixing, sprayer 35 uniformly sprays the image on the recording medium with a finishing solution.

The remaining structure is similar to that shown in FIG. 1.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be construed as being included therein.

What is claimed is:

1. An image forming method comprising steps of:

(a) forming a resin-formed image on a recording medium;

(b) fixing the image on the recording medium; and (c) applying a solution comprising a plasticizer to the image fixed on the recording medium in order to plasticize the image.

2. The method as claimed in claim 1 wherein said image is obtained by overlaying a plurality of resin-formed images.

3. The method as claimed in claim 2 wherein colors of each of said images are different from one another.

4. The method as claimed in claim 1 wherein the forming step is performed by electrophotography.

5. The method as claimed in claim 1 wherein the plasticizer is one selected from the group consisting of tributhyl phosphate, tricresyl phosphate, dimethyl phthalate, diethyl phthalate, dibutyl phthalate, diisodesyl phthalate, tri-2-ethylhexyl trimeritate, butyl olete, dimethyl adipate, dibutyl adipate, dibutyldiglycol adipate, dibutyl sebacate and methyl acetyl ricinolate.

6. The method as claimed in claim 1 wherein said solution further comprises at least one solvent selected from the group consisting of water, methanol, ethanol and acetone.

7. The method as claimed in claim 6 wherein an amount of the plasticizer is not less than 1 percent by weight on the basis of the solution.

8. The method as claimed in claim 1 wherein said image is formed by a toner containing a resin and a colorant.

9. The method as claimed in claim 8 wherein said resin is at least one selected from the group consisting of styrene-acrylic resin and polyester resin.

10. The method as claimed in claim 8 wherein said toner further comprises a charge controlling agent.

11. The method as claimed in claim 8 wherein said toner further comprises an offset preventing agent.

12. The method as claimed in claim 8 wherein said toner further comprises a fluidizing agent.

13. The method as claimed in claim 1 wherein the applying step is performed by spraying the solution.

14. The method as claimed in claim 1 wherein said recording medium is made of a fabric.

15. An image forming method comprising steps of:

(a) forming a resin-formed image on a recording medium; and (b) applying a solution comprising a plasticizer and a surfactant to the image formed on the recording medium in order to plasticize the image.

16. The method as claimed in claim 15 wherein an amount of the surfactant is in a range between 0.1 and 10 percent by weight on the basis of the solution.

17. The method as claimed in claim 16 wherein the amount of the surfactant is in the range between 1 and 3 percent by weight on the basis of the solution.

18. The method as claimed in claim 15 wherein said recording medium is made of a fabric.

19. An image forming apparatus comprising:

an image forming device which forms a resin-formed image on a recording medium;

a fixing device which fixes the image on the recording medium permanently; and an applying device which applies a solution comprising a plasticizer to the image formed on the recording medium.

20. The apparatus as claimed in claim 19 wherein said applying device comprises:

a container which stores the solution; and a sprayer, provided at a location confronting to the recording medium, which pumps the solution from the container and sprays the recording medium with the solution.

21. An image forming apparatus comprising:

an electrostatic latent image carrying member;

a latent image forming device for forming an electrostatic latent image on the electrostatic latent image carrying member;

a developing device for developing the electrostatic latent image into a developed image, said developing device accommodating a resin-formed toner;

a transfer device for transferring the developed image from the electrostatic latent image carrying member onto a recording medium;

a fixing device for fixing the transferred image on the recording medium permanently; and an applying device which applies a solution comprising a plasticizer to the image formed on the recording medium.

22. An image forming apparatus comprising:

an image forming means for forming a resin-formed image on a recording medium;

a fixing means for fixing the image on the recording medium; and an applying means for applying a solution comprising a plasticizer to the image formed on the recording medium.

23. A fabric printing method comprising steps of:

(a) forming a resin-formed image on a fabric;

(b) fixing the image on the fabric permanently; and (d) applying a solution comprising a plasticizer to the image fixed on the fabric in order to plasticize the image.

24. A fabric printing method comprising steps of:

(a) forming a plurality of resin-formed images having different colors by electrophotography;

(b) overlaying the images on a fabric in order to obtain a color image;

(c) fixing the color image on the fabric permanently; and (d) applying a solution comprising a plasticizer to the color image fixed on the fabric in order to plasticize the image.

25. A fabric printing method comprising steps of:

(a) producing a resin-formed image which is fixed on a fabric permanently; and (b) applying a solution comprising a plasticizer to the image fixed on the fabric in order to plasticize the image.

* * * * *